US005128726A

United States Patent [19]

Cassano et al.

[11] Patent Number: 5,128,726

[45] Date of Patent: Jul. 7, 1992

[54] SHEET TRANSPORT SYSTEM WITH IMPROVED GRIPPING AND REGISTRATION MECHANISM

[75] Inventors: James R. Cassano, Penfield; Vittorio Castelli, Yorktown Heights; John E. Kosko, Victor; Thomas F. Cooper, Farmington; Scott C. Durland, Rochester; Richard M. Dastin, Fairport, all of N.Y.; Jan J. van der Steen, Horst, Netherlands

[73] Assignee: Xerox Corporation, Stamford, Conn.

[21] Appl. No.: 630,598

[22] Filed: Dec. 20, 1990

[51] Int. Cl.[5] ..... G03G 21/00

[52] U.S. Cl. ..... 355/308; 271/204; 271/277; 355/309; 355/317; 355/321

[58] Field of Search ..... 198/803.7; 271/82, 204, 271/205, 277; 355/308, 309, 317, 321

[56] References Cited

U.S. PATENT DOCUMENTS

| | | | |
|---|---|---|---|
| 3,148,878 | 9/1964 | Eichorn | 271/204 |
| 3,797,929 | 3/1974 | Deacon et al. | 355/309 |
| 3,924,849 | 12/1975 | Murakami | 271/277 |
| 4,629,176 | 12/1986 | Ceelen | 271/204 |
| 4,849,795 | 4/1989 | Spehrley, Jr. et al. | 355/317 |
| 4,921,294 | 4/1990 | Klopfenstein | 198/803.7 |
| 4,972,234 | 11/1990 | Tanaka et al. | 355/309 |

*Primary Examiner*—A. T. Grimley
*Assistant Examiner*—P. Stanzione
*Attorney, Agent, or Firm*—Paul J. Maginot

[57] ABSTRACT

A sheet transport system having a sheet gripper which includes at least one resilient member used to bias an upper gripping portion toward a lower gripping portion so as to releasably secure the leading edge of a sheet therebetween. The resilient member includes a stop which functions to register the sheet within the sheet gripper.

14 Claims, 4 Drawing Sheets

SHEET TRANSPORT SYSTEM WITH IMPROVED GRIPPING AND REGISTRATION MECHANISM

This invention relates generally to an electrophotographic printing machine, and more particularly concerns a sheet transport for moving a sheet in a path to enable a toner image to be transferred thereto. The invention also particularly concerns a sheet transport for moving a sheet in a recirculating path to enable successive toner powder images to be transferred thereto in superimposed registration with one another.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

During initial receipt of the copy sheet by the sheet gripper, it is desirable to properly register the sheet within the sheet gripper in order to prevent the toner image from being transferred to the copy sheet in a skewed manner. As a result, some sheet grippers have been designed with a stop positioned internal thereto. The stop is usually molded integral with one of the jaws of the sheet gripper or a separate member is affixed near the copy sheet opening of the sheet gripper. It is desirable to provide a sheet gripper with a stop that has a reduced number mechanical parts and is inexpensive to manufacture.

The following disclosures may be relevant to various aspects of the present invention:

U.S. Pat. No. 148,878, Patentee: Eichorn Issued: Sep. 15, 1964,

U.S. Pat. No. 3,797,929, Patentee: Deacon et al. Issued: Mar. 19, 1974,

U.S. Pat. No. 3,924,849, Patentee: Murakami, Issued: Dec. 9, 1975,

U.S. Pat. No. 4,629,176, Patentee: Ceelen, Issued: Dec. 16, 1986,

The relevant portions of the foregoing disclosures may be briefly summarized as follows:

U.S. Pat. No. 3,148,878 discloses a sheet feeding mechanism having having a plurality of sheet grippers. Each sheet gripper is provided with a spaced leg portion which serves as a guide and stop to align the leading edge of a sheet inserted into the sheet gripper.

U.S. Pat. No. 3,797,929 describes a transport system for a photocopy machine having multiple sheet grippers mounted on transport chains. Each sheet gripper has jaws which open and close as a result of cams positioned near the path of movement of the sheet gripper. Each sheet gripper further includes a stop which is welded onto the jaws to stop the leading edges of copy sheets which are inserted between the jaws.

U.S. Pat. No. 3,924,849 describes a paper gripping device for use with a chain driven paper carriage. A sheet gripper is mounted between driving chains of the paper carriage and has a U-shaped configuration. The sheet gripper includes an upper jaw which has a stop integrally formed therein.

U.S. Pat. No. 4.629,176 discloses a paper sheep gripper which has upper and lower gripper portions made from extruded aluminum. The lower gripper portion has a stop integrally formed therein.

In accordance with one aspect of the present invention, there is provided an apparatus for releasably gripping and registering a sheet. The apparatus comprises a first member and a second member adapted to be movable relative to said first member. The apparatus further comprises means for resiliently urging the second member to move toward the first member in order to secure the leading edge of the sheet therebetween and substantially simultaneously registering the leading edge of the sheet within the apparatus.

Pursuant to another aspect of the present invention, there is provided an apparatus for advancing a sheet through a transfer zone and into registration with information developed on a moving member. The apparatus comprises means for advancing the sheet in a recirculating path of movement. The apparatus further comprises means, operatively associated with the advancing means, for releasably securing the sheet to the advancing means, the securing means comprising a first member, a second member adapted to be movable relative to the first member, and means for resiliently urging the second member to move toward the first member in order to secure the leading edge of the sheet therebetween and substantially simultaneously registering the leading edge of the sheet within the advancing means.

Other features of the present invention will become apparent as the following description proceeds and upon reference to the drawings, in which.

Figure 1:
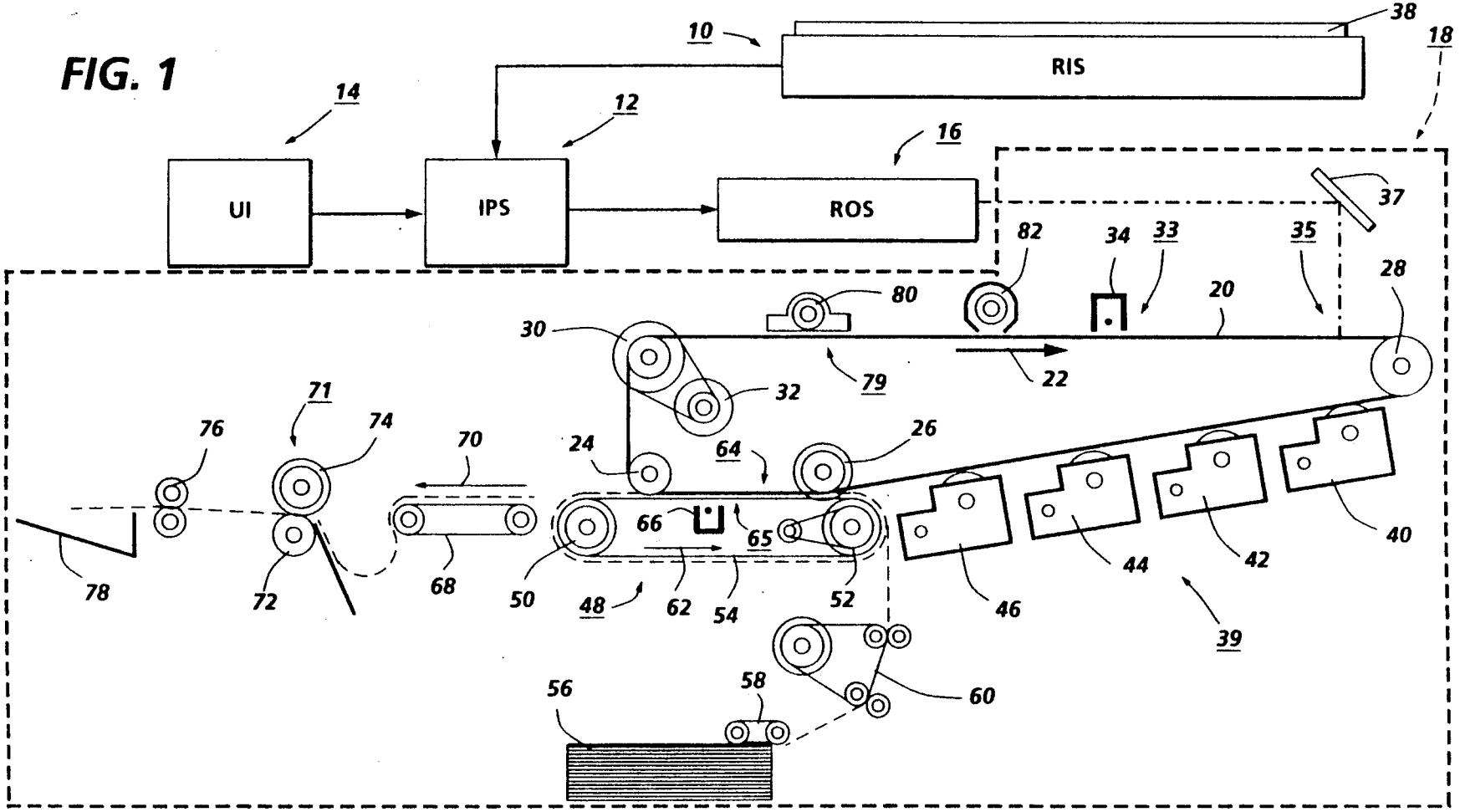
FIG. 1 is a schematic elevational view showing an electrophotographic printing machine incorporating the features of the present invention therein.
Figure 5:
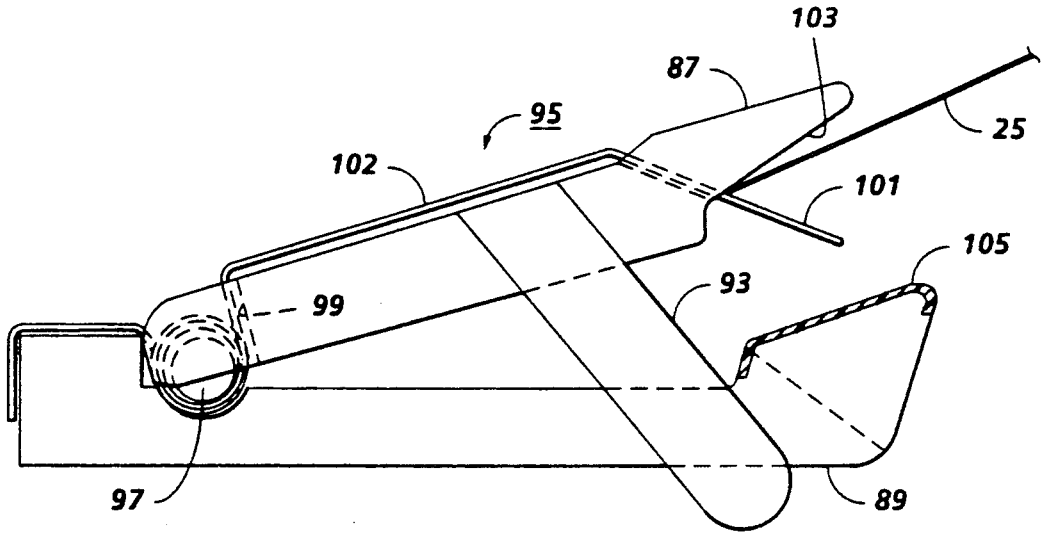
Figure 6:
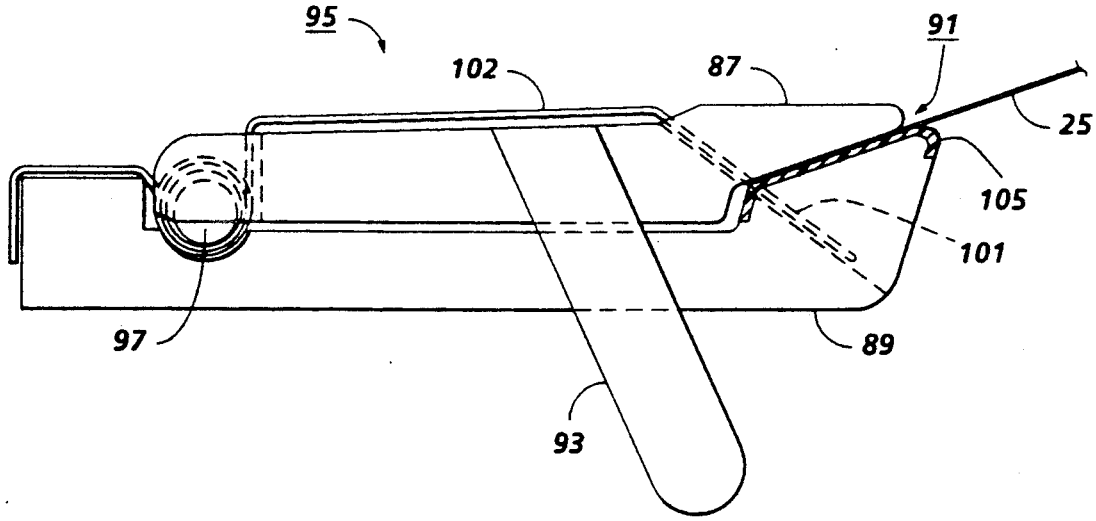

FIG. 5 is a schematic elevational view of the gripping portions of the sheet gripper of the sheet transport system used in the electrophotographic printing machine of FIG. 1 with the sheet gripper in the open position and further showing a sheet registered within the sheet gripper; and FIG. 6 is a schematic elevational view of the gripping portions of the sheet gripper of the sheet transport system used in the electrophotographic printing machine of FIG. 1 with the sheet gripper in the closed position and further showing a sheet secured within the sheet gripper.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire orginal document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (see FIGS. 2–6), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport system will be discussed hereinafter with reference to FIGS. 2–6. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
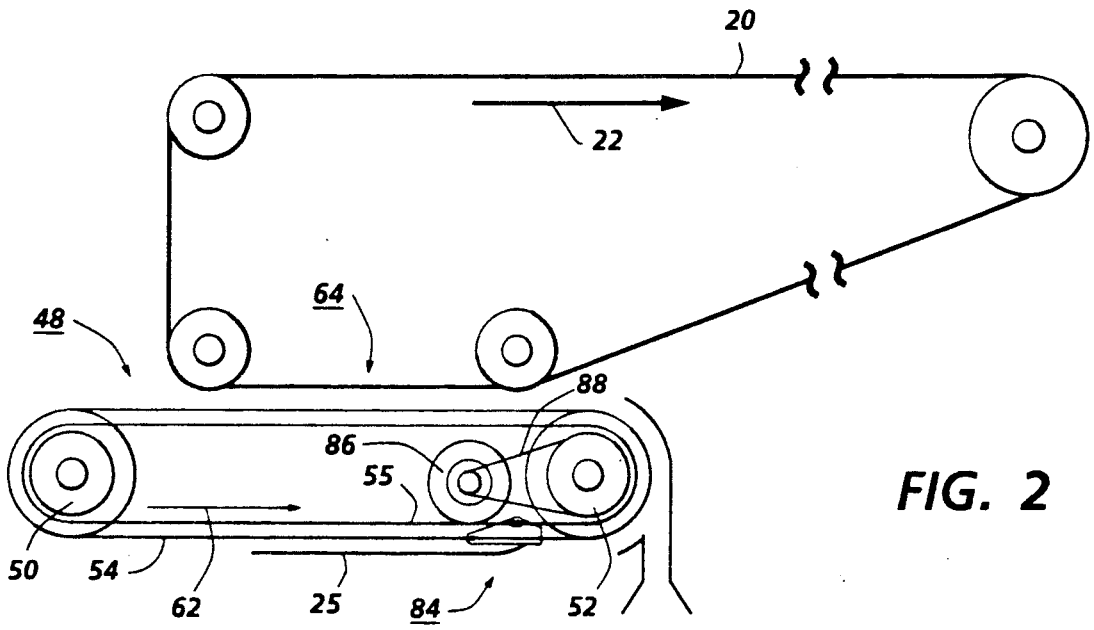
FIG. 2 is a schematic elevational view showing further details of the sheet transport system used in the electrophotographic printing machine of FIG. 1.
Figure 3:
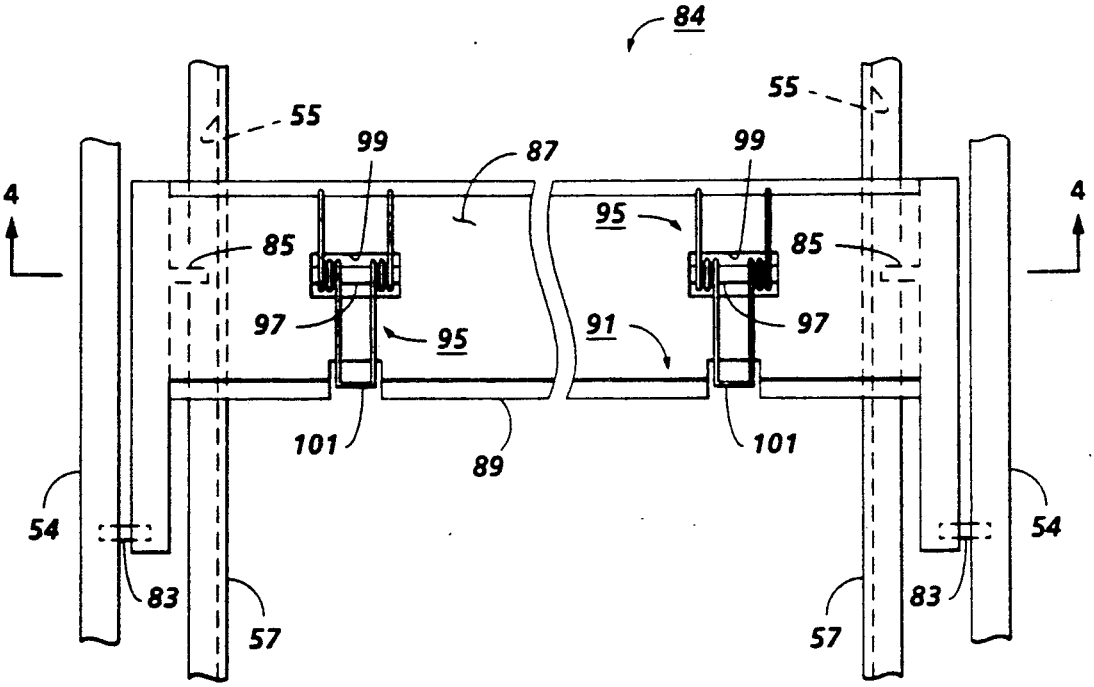
FIG. 3 is a schematic planer view showing the sheet gripper of the sheet transport system used in the electrophotographic printing machine of FIG. 1.
Figure 4:
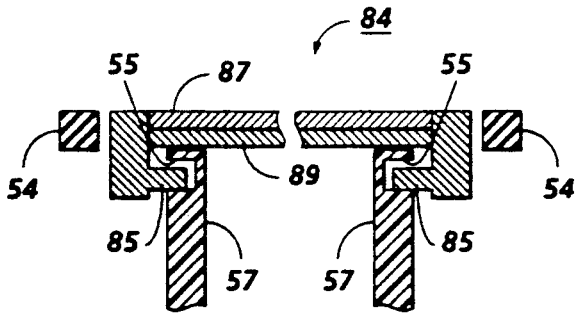
FIG. 4 is a sectional elevational view taken in the direction of arrows 4—4 in FIG. 3 of the opposed side marginal regions of the sheet gripper.

FIG. 2 shows sheet gripper 84 of sheet transport 48 transporting sheet 25 in the direction of arrow 62 in a recirculating path of movement. FIGS. 3 shows sheet gripper 84 suspended between two spaced apart timing belts 54. FIG. 4 shows a sectional elevational view of the opposed side marginal regions of sheet gripper 84. Timing belts 54 are mounted on rollers 50 and 52. Belts 54 define a continuous path of movement of sheet gripper 84. A motor 86 is coupled to roller 52 by a drive belt 88. Sheet gripper 84 includes a pair of guide members 85. A pair of spaced apart and continuous tracks 55 are respectively positioned substantially adjacent belts 54. Tracks 55 are respectively defined by a pair of track supports 57. Each of guide members 85 is slidably positioned within a respective track 55. Sheet gripper 84 further includes an upper sheet gripping portion 87 and a lower sheet gripping portion 89 which are biased toward each other by a plurality of springs, each being generally indicated by the reference numeral 95. Each of springs 95 includes a first segment 101 and a second segment 102 as shown in FIGS. 5 and 6. First segment 101 is offset from second segment 102 and defines a stop for registering sheet 25 within the sheet gripper. A plurality of securing pins 97 are respectively positioned within apertures 99 of upper gripping portion 87 and secured thereto to hold springs 95 in place so as to bias upper sheet gripping portion 87 toward lower sheet gripping portion 89. The sheet gripper further includes a pair of cam followers 93 which are attached to the opposed side marginal regions of upper gripping portion 87 and function with a pair of cams (not shown) to open and close the gripping portions at predetermined intervals. The cams are positioned at predetermined locations in the recirculating path of movement of the sheet gripper. As the cam followers are respectively directed into contact with the cams while traveling their path of movement, the extreme lower edge of each cam follower is forced to follow the profile of the surface of its respective cam. As the cam followers pass over the cams, the cam followers are actuated to overcome the bias of springs 95 thereby causing the sheet gripper to be open. After the cam followers pass over the cams and are no longer in contact therewith, the sheet gripper closes thereby causing gripping portion 87 to cooperate with gripping portion 89 to grasp and securely hold the leading edge of sheet 25. The area at which the gripping portions 87 and 89 grasp sheet 25 defines a gripping nip, generally indicated by the reference numeral 91. Positioned upon lower sheet gripping portion 89, near gripping nip 91, is a silicone rubber coating 105. With coating 105 positioned as above, the frictional grip of sheet 25 between the gripping portions is increased. Belts 54 are respectively connected to the opposed side marginal regions of sheet gripper 84 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected.

FIG. 5 shows the orientation of upper gripping portion 87 relative to lower gripping portion 89 when cam follower 93 is actuated to overcome the bias of springs 95. When the upper gripping portion is pivoted upward relative to the lower gripping portion, an opening is defined to receive sheet 25 therein. As sheet 25 enters the above opening, the sheet is prevented from advancing forward relative to sheet gripper 84 by stops 101 of springs 95 and also by a stop 103 of upper gripping portion 87. The stops function to register the leading edge of the sheet within the sheet gripper. During opening of the gripping portions, stops 101 and 103 move in unison with one another. It should noted that sheet registration may be obtained by the leading edge of the sheet being forced against springs 95 alone. If desired, stops 101 may be formed in other configurations and still accomplish registration of the leading edge of the sheet.

FIG. 6 shows the orientation of upper gripping portion 87 relative to lower gripping portion 89 when the cam followers are moved to a non-actuated position. The cam followers are in this position when they are not in contact with the cams. Once the leading edge of sheet 25 is within the opening of sheet gripper 84 and positioned adjacent stops 101 and 103, springs 95 resiliently urge upper gripping portion 87 toward lower gripping portion 89 so as to close the above opening and secure the leading edge of sheet 25 therebetween. During closing of the gripping portions, stops 101 and 103 move in unison with one another. Once the sheet is secured within the sheet gripper, the sheet transport system will then proceed to transport the sheet in a recirculating path of movement as previously discussed.

In recapitulation, at least one resilient member is used in a sheet gripper of a sheet transport system to bias an upper gripping portion toward a lower gripping portion so as to releasably secure the leading edge of a sheet therebetween. The resilient member includes a stop which functions to register the sheet within the sheet gripper.

It is, therefore, apparent that there has been provided in accordance with the present invention, a sheet transport system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for releasably gripping and registering a sheet, comprising:

a first member;

a second member adapted to be movable relative to said first member; and means for resiliently urging said second member to move toward said first member in order to secure the leading edge of the sheet therebetween, said urging means comprising means for registering the leading edge of the sheet within the apparatus.

2. The apparatus of claim 1, wherein said second member comprises a stop portion adapted to contact the leading edge of the sheet substantially simultaneously with said urging means registering the leading edge of the sheet within the apparatus.

3. The apparatus of claim 2, wherein said urging means further comprises a plurality of springs, at least one of the springs being positioned to exert a force to bias said second member toward said first member, wherein the spring comprises a second stop portion adapted to contact the leading edge of the sheet.

4. The apparatus of claim 3, further comprising means for pivoting said second member relative to the first member so as to define an opening to receive the leading edge of the sheet, said pivoting means being movable to a non-actuated position so that the spring resiliently urges said second member toward said first member in order to secure the leading edge of the sheet therebetween.

5. The apparatus of claim 4, wherein the first stop portion and the second stop portion move in unison therewith.

6. The apparatus of claim 3, wherein the spring includes a first segment and a second segment, the first segment being offset from the second segment and defining its respective second stop portion.

7. An apparatus for advancing a sheet through a transfer zone and into registration with information developed on a moving member, comprising:

means for advancing the sheet in a recirculating path of movement; and means, operatively associated with said advancing means, for releasably securing the sheet to said advancing means, said securing means comprising a first member, a second member adapted to be movable relative to the first member, and means for resiliently urging the second member to move toward the first member in order to secure the leading edge of the sheet therebetween, said urging means comprising means for registering the leading edge of the sheet within the advancing means.

8. The apparatus of claim 7, wherein the second member comprises a stop portion adapted to contact the leading edge of the sheet substantially simultaneously with the urging means registering the leading edge of the sheet within said advancing means.

9. The apparatus of claim 8, wherein the urging means further comprises a plurality of springs, at least one of the springs being positioned to exert a force to bias the second member toward the first member, wherein the spring comprises a second stop portion adapted to contact the leading edge of the sheet.

10. The apparatus of claim 9, further comprising means, located at a predetermined position in the recirculating path of movement, for pivoting said second member relative to the first member so as to define an opening to receive the leading edge of the sheet, said pivoting means being movable to a non-actuated position so that the spring resiliently urges said second member toward said first member in order to secure the leading edge of the sheet therebetween.

11. The apparatus of claim 10, wherein the first stop portion and the second stop portion move in unison therewith.

12. The apparatus of claim 9, wherein the spring includes a first segment and a second segment, the first segment being offset from the second segment and defining its respective second stop portion.

13. The apparatus of claim 7, wherein:

each of a plurality of toner images are successively developed on the moving member and advanced into registration with the sheet; and said advancing means moves the sheet through the transfer zone a plurality of times so as to successively transfer the toner images onto the sheet in registration with one another.

14. The apparatus of claim 13, wherein each of the toner images is a different color.

* * * * *